US010258212B2

(12) United States Patent
Nam et al.

(10) Patent No.: US 10,258,212 B2
(45) Date of Patent: Apr. 16, 2019

(54) CLEANER

(71) Applicant: LG ELECTRONICS INC., Seoul (KR)

(72) Inventors: Bohyun Nam, Seoul (KR); Inbo Shim, Seoul (KR); Jihoon Sung, Seoul (KR); Sojin Park, Seoul (KR); Seunghyun Song, Seoul (KR); Sangkyu Lee, Seoul (KR); Changhwa Sun, Seoul (KR); Sangjo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 95 days.

(21) Appl. No.: 15/598,781

(22) Filed: May 18, 2017

(65) Prior Publication Data

US 2017/0332859 A1 Nov. 23, 2017

(30) Foreign Application Priority Data

May 20, 2016 (KR) ..... 10-2016-0062415
Jan. 26, 2017 (KR) ..... 10-2017-0013012

(51) Int. Cl.
*A47L 9/04* (2006.01)
*A47L 9/14* (2006.01)
*A47L 9/28* (2006.01)

(52) U.S. Cl.
CPC ..... *A47L 9/0477* (2013.01); *A47L 9/0405* (2013.01); *A47L 9/1409* (2013.01); *A47L 9/28* (2013.01); *A47L 2201/00* (2013.01)

(58) Field of Classification Search
CPC .... A47L 9/0477; A47L 9/0405; A47L 9/1409; A47L 9/28; A47L 2201/00
See application file for complete search history.

(56) References Cited

U.S. PATENT DOCUMENTS 8,122,562 B2 * 2/2012 Krebs ..... A47L 7/0009 15/320
8,776,311 B2 7/2014 Genn et al.
(Continued)

FOREIGN PATENT DOCUMENTS

EP 1 237 459 9/2002
EP 2 882 328 6/2015
(Continued)

OTHER PUBLICATIONS

European Search Report dated Oct. 2, 2017 issued in Application No. 17000864.3.
(Continued)

*Primary Examiner* — Dung Van Nguyen
(74) *Attorney, Agent, or Firm* — KED & Associates, LLP

(57) ABSTRACT

A cleaner includes: a cleaner body having therein a module mounting portion; a rotation driving portion provided at one side of the module mounting portion; and a cleaning module detachably mounted to the module mounting portion through one side of the cleaner body, wherein the cleaning module includes: a holder linearly inserted into or withdrawn from the module mounting portion in a side direction of the cleaner body; and a cleaning member supported by the holder so as to be inserted or withdrawn into or from the module mounting portion, together with the holder when the holder is inserted thereinto or withdrawn therefrom, and the cleaning member rotated by a driving force provided from the rotation driving portion.

20 Claims, 8 Drawing Sheets

(56) References Cited

U.S. PATENT DOCUMENTS

| | | | | |
|---|---|---|---|---|
| 2014/0041136 | A1* | 2/2014 | Kerr | A47L 9/0411 15/3 |
| 2014/0196236 | A1* | 7/2014 | Ventress | A46B 13/005 15/182 |
| 2016/0100727 | A1* | 4/2016 | Barrett | A47L 9/0477 15/391 |

FOREIGN PATENT DOCUMENTS

| | | |
|---|---|---|
| JP | 2005-312589 | 11/2005 |
| JP | 2013-220309 | 10/2013 |
| KR | 10-2014-0114868 | 9/2014 |
| KR | 10-1476156 | 12/2014 |
| KR | 10-2015-0038598 | 4/2015 |
| KR | 10-2015-0081767 | 7/2015 |
| KR | 10-2016-0136360 | 11/2016 |
| KR | 10-2017-0027418 | 3/2017 |

OTHER PUBLICATIONS

Korean Office Action dated Feb. 9, 2018 issued in Application No. 10-2017-0013012.

Korean Notice of Allowance dated Aug. 16, 2018 issued in KR Application No. 10-2017-0013012.

* cited by examiner

CLEANER

CROSS-REFERENCE TO RELATED APPLICATION(S)

Pursuant to 35 U.S.C. § 119(a), this application claims the benefit of an earlier filing date of and the right of priority to Korean Application No. 10-2016-0062415, filed in Korea on May 20, 2016, and No. 10-2017-0013012, filed on Jan. 26, 2017, the contents of which are incorporated by reference herein in their entirety.

BACKGROUND

1. Field

This specification relates to a cleaner having a cleaning module which can be sanitarily managed.

2. Background

A cleaner is an apparatus for performing a vacuum cleaning function by separating dust and foreign materials from sucked air, and a mop cleaning function through a mopping operation. The cleaner simultaneously sucks air and dust, and separates the dust from the air. The dust separated from the air is collected at a dust collector, and the air is discharged out of the cleaner. During such processes, dust is accumulated not only in the dust collector, but also in the cleaner.

In order to maintain a cleaned state and a cleaning function of the cleaner, the cleaner should be controlled. The control of the cleaner means a periodic discharge of dust collected in the dust collector, a removal of dust accumulated on other components rather than the dust collector, etc. In order to control the cleaner, components of the cleaner should be separated from a cleaner body. In this process, a user may manually handle the components, and may handle even dust accumulated on the cleaner by hand. This handling may cause a problem to the user in a sanitary aspect.

For instance, in a cleaner disclosed in Korean Laid-Open Patent Publication No. 10-2015-0038598, an T-shaped tool is used to open a cap. Then, a user should take an agitator out of a cleaner head by hand. In this process, since the user should hold the agitator with his/her hands, there is a problem in a sanitary aspect.

Further, this cleaner requires an T-shaped tool to open the cap. Besides, when a user takes the agitator out of the cleaner head by holding one end of the agitator, the agitator becomes inclined in the removal direction. This incline may cause dust on the agitator to be transferred to a housing or to drop onto a floor.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. A singular representation may include a plural representation unless it represents a definitely different meaning from the context.

Figure 1:
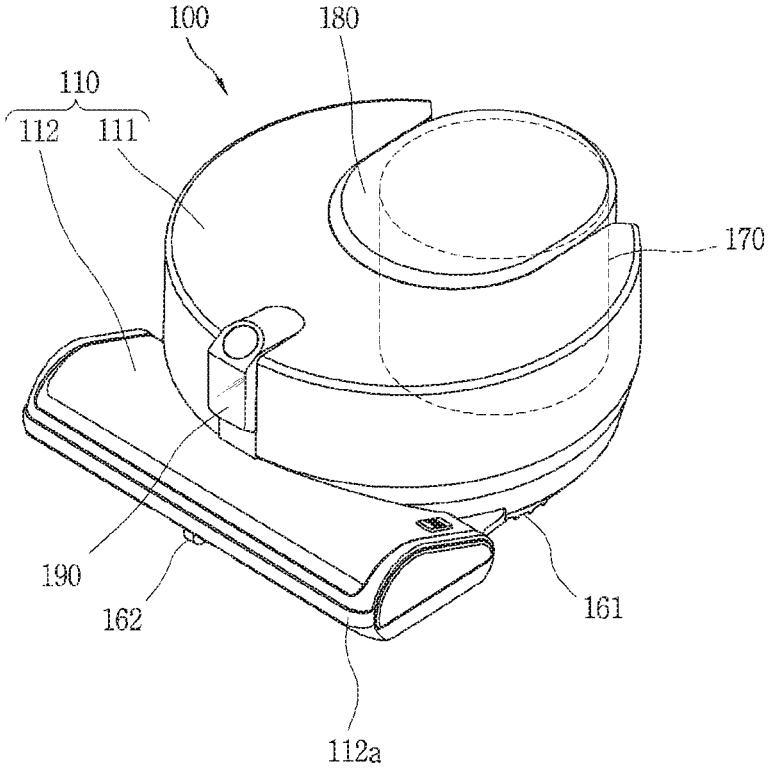
FIG. 1 is a perspective view showing an example of a cleaner according to the present disclosure.
Figure 2:
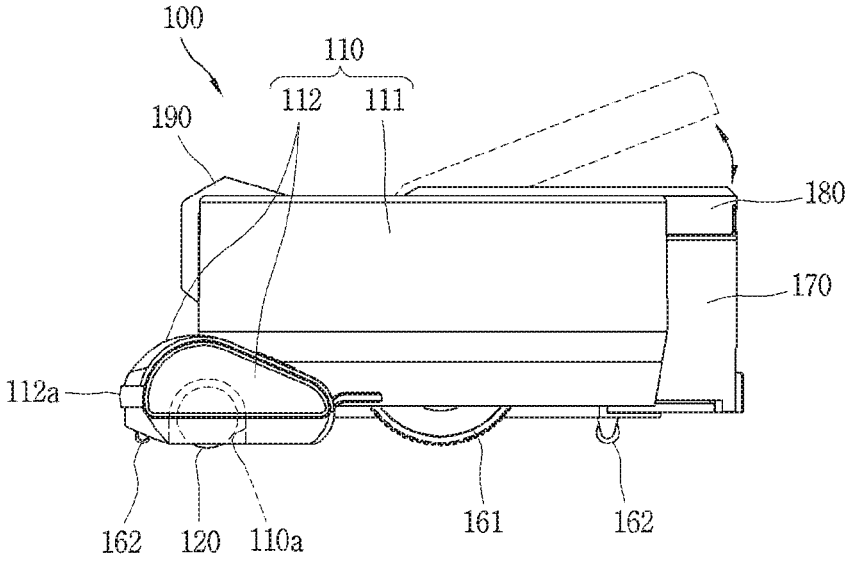
FIG. 2 is a side sectional view of the cleaner shown in FIG. 1.

FIG. 1 is a perspective view showing an example of a cleaner according to the present disclosure, and FIG. 2 is a side sectional view of the cleaner shown in FIG. 1. The drawings illustrate a robot cleaner 100 which sucks dust on a floor while autonomously moving on a predetermined region. However, the present disclosure is not limited to the robot cleaner 100, but may be applicable to a general vacuum cleaner such as a canister type cleaner or an upright type cleaner. The robot cleaner 100 may be configured not only to suck dust on a floor, but also to perform a mopping operation on a floor. For this, the robot cleaner 100 includes a cleaner body 110 and a cleaning module 120.

The cleaner body 110 forms an appearance of the robot cleaner 100. Various components including a controller (not shown) for controlling the robot cleaner 100 are mounted in the cleaner body 110. In the drawings, the cleaner body 110 includes a main housing 111 and a cleaning module housing 112. The cleaning module housing 112 is coupled to the main housing 111 in a protruded manner. A main printed circuit board (PCB) which constitutes the controller is mounted in the main housing 111, and a dust container 170 is coupled to the main housing 111. A suction motor for sucking dust, a driving motor for rotating a cleaning module to be explained later, etc. may be mounted in the main housing 111.

A module mounting portion 110*a* to which the cleaning module 120 is detachably coupled is formed at the cleaning module housing 112. However, the present disclosure is not limited to this. That is, the cleaner body 110 may include only the main housing 111. In this case, the module mounting portion 110*a* may be formed at the main housing 111.

A bumper switch 112*a* configured to sense a physical collision may be installed at the cleaner body 110. The bumper switch 112*a* may include a bumper member 112*a*' which inwardly moves by a physical collision with an obstacle, and a switch 112*a*" (see FIGS. 7A and 7B) which is activated when the bumper member 112*a*' moves inwardly. In the drawings, the bumper switch 112*a* is provided at the cleaning module housing 112. The bumper switch 112*a* is provided on a front surface of the cleaning module housing 112. In some cases, the bumper switches 112*a* may be provided on both side surfaces of the cleaning module housing 112.

The cleaner body 110 is provided with wheels for driving. The wheels may be provided on right and left sides of the cleaner body 110. By the wheels, the cleaner body 110 may move back and forth or right and left, or may be rotated. For instance, in case of the robot cleaner 100 having an autonomous moving function, the wheels may be configured as driving wheels 161 rotated by receiving a driving force from a driving motor. As another example, in a case where the cleaner body 110 is moved by a user's manipulation, the wheels may be configured to have only a general rolling function on a floor.

The cleaner body 110 may be further provided with supplementary wheels 162. The supplementary wheels 162 are configured to support the cleaner body 110 together with the driving wheels 161, and to assist a driving of the robot cleaner 100 by the driving wheels 161. As shown, the supplementary wheels 162 may be mounted to at least one of the main housing 111 and the cleaning module housing 112. For instance, if the cleaning module housing 112 protrudes from the main housing 111, the supplementary wheels 162 may be provided at the cleaning module housing 112 as well as the main housing 111, for a stable driving of the robot cleaner 100.

Figure 4:
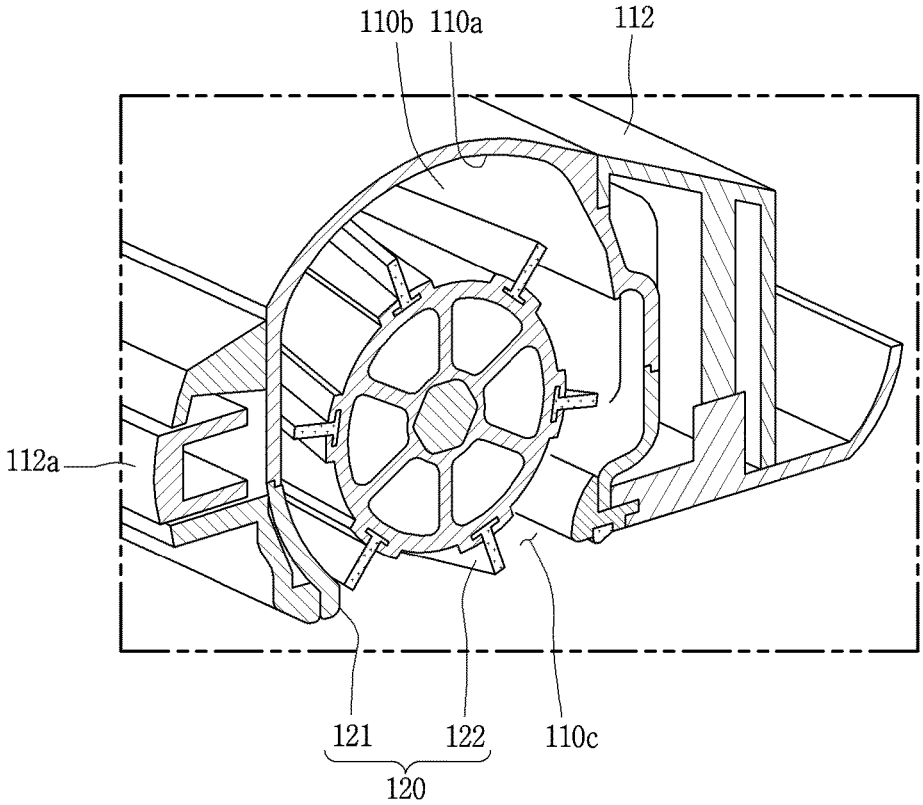
FIG. 4 is a sectional view of the cleaning module housing and a cleaning module shown in FIG. 3.

The cleaning module 120 is formed to clean a floor through a second opening 110*c* (see FIG. 4). Dust and foreign materials included in air sucked through the cleaning module 120 are filtered to be collected in a dust container 170. Then, the air having dust and foreign materials removed therefrom is discharged to the outside of the cleaner body 110. An air suction flow path (not shown), which guides a flow of air from the module mounting portion 110*a* to the dust container 170, may be formed in the cleaner body 110. And an air discharge flow path (not shown), which guides a flow of air from the dust container 170 to the outside of the cleaner body 110, may be formed in the cleaner body 110.

The cleaning module 120 may selectively include different types of cleaning members (or cleaning rollers) 122. The cleaning member 122 may be a rotating structure, such as an agitator, a brush, a rag (or mop), etc. A type of the cleaning module 120 may be sorted according to a type of the cleaning member. For instance, the cleaning module 120 having a brush may be sorted as a brush module, and the cleaning module 120 having a mop may be sorted as a mop module. One of the brush module and the mop module may be detachably coupled to the module mounting portion 110*a*. For instance, a user may replace the cleaning member or the cleaning module 120 according to a cleaning purpose.

The type of the cleaning member is not limited to a brush or a mop. Accordingly, cleaning modules having different types of cleaning members may be called a first type cleaning module and a second type cleaning module. The first type cleaning module includes a first type cleaning member, and the first type cleaning member may mean a brush, for example. Likewise, the second type cleaning module includes a second type cleaning member, and the second type cleaning member may mean a mop rather than a brush, etc.

At least one of a filter and a cyclone for filtering dust and foreign materials from sucked air may be provided at the dust container 170. The robot cleaner 100 may be provided with a dust container cover 180 which covers the dust container 170. In a state that the dust container cover 180 is provided to cover an upper surface of the dust container 170, separation of the dust container 170 from the cleaner body 110 may be prevented by the dust container cover 180.

FIG. 2 illustrates a configuration in which the dust container cover 180 is coupled to the cleaner body 110 by a hinge and is formed to be rotatable around the hinge. The dust container cover 180 may be fixed to the dust container 170 or the cleaner body 110, such that a covered state of the upper surface of the dust container 170 may be maintained.

If the robot cleaner 100 has an autonomous moving function, a sensing unit 190 for sensing a peripheral situation may be provided at the cleaner body 110. The controller may sense an obstacle or a terrain feature, or may generate a map of a driving region, through the sensing unit 190.

Figure 3:
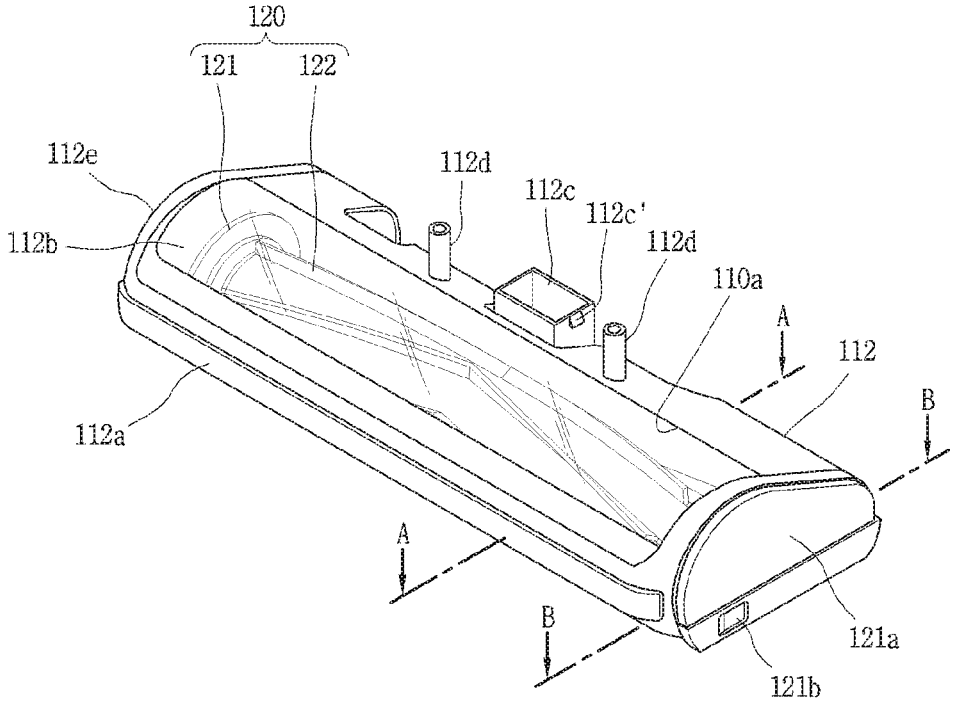
FIG. 3 is a disassembled perspective view showing a separated state of a cleaning module housing from a main housing shown in FIG. 1.

FIG. 3 is a disassembled perspective view showing a separated state of the cleaning module housing 112 from the main housing shown in FIG. 1. And FIG. 4 is a sectional view of the cleaning module housing 112 and the cleaning module 120 shown in FIG. 3 (a sectional view taken along line 'A-A' in FIG. 3). The cleaning module housing 112 is provided therein with the module mounting portion 110*a*. The cleaning module housing 112 encloses the cleaning module 120 so as to protect the cleaning module 120 mounted to the module mounting portion 110*a*.

The cleaning module housing 112 may have a configuration that it extends right and left. The "right" and "left" sides mean directions when the robot cleaner 100 is viewed from a front side or directions along an center axis of rotation for the cleaning member 122. Also, a "front" side of the cleaning module housing 112 means an installation direction of the bumper switch 112*a*.

At least part of the cleaning module housing 112 may be formed of a transparent member (or cover) 112*b* such that the cleaning module 120, when mounted in the cleaning module housing 112, may be exposed visually. FIG. 3 shows that a part of the cleaning module housing 112, which is positioned in view of a user, is formed of a transparent material. With such a configuration, the cleaning module 120 mounted to the module mounting portion 110*a* of the cleaning module housing 112 may be exposed to the outside visually, and a user may visually check a state of the cleaning module 120.

A connection passage 112*c* is formed at the cleaning module housing 112. The connection passage 112*c* corresponds to a flow path along which dust sucked by a suction force provided by a suction motor moves from the cleaning module housing 112 to the main housing 111. The connection passage 112*c* is connected to the air suction flow path of the main housing 111 shown in FIG. 1. Accordingly, air and dust sucked through a bottom region of the cleaning module housing 112 flow to the air suction flow path via the connection passage 112*c*.

A protrusion portion 112*c*' may be formed on an outer side surface of the connection passage 112*c*. A locking jaw corresponding to the protrusion portion 112*c*' is formed at the cleaning module housing 112. Once the cleaning module housing 112 is coupled to the main housing 111, the connection passage 112*c* is inserted into the main housing 111, and the protrusion portion 112*c*' is coupled to the locking jaw.

The cleaning module housing 112 may be provided with a position fixing portion (or extension) 112*d*. The position fixing portions 112*d* may be formed at both sides of the connection passage 112*c*, and may protrude from the cleaning module housing 112. A position fixing groove (not shown) corresponding to the position fixing portion 112*d* is formed at the main housing 111. Once the cleaning module housing 112 is coupled to the main housing 111, the position fixing portion 112*d* is inserted into the position fixing groove.

Referring to FIG. 4, the cleaning module 120 is mounted to the module mounting portion 110*a* of the cleaning module housing 112 and in an interior space 110*b* defined in the cleaning module housing 112. The cleaning module 120 includes a holder (or mount) 121 and a cleaning member 122.

The holder 121 is formed to support the cleaning member 122 such that the cleaning member 122 is rotatable. Although not shown in FIG. 4, the holders 121 are coupled to two ends of the cleaning member 122, and thus the holder 121 and the cleaning member 122 are coupled to each other so as to be relatively rotatable with respect to each other. The cleaning member 122 is formed to be rotatable centering around a rotation shaft which extends axially in right and left directions. FIGS. 3 and 4 show that an agitator, as an example of the cleaning member 122, is mounted so as to be rotatable about the rotation shaft. Reference numeral 112*e* denotes a first side surface cover, 121*a* denotes a second side surface cover, and 121*b* denotes a hook manipulator (or release button), which will be described below.

Figure 5:
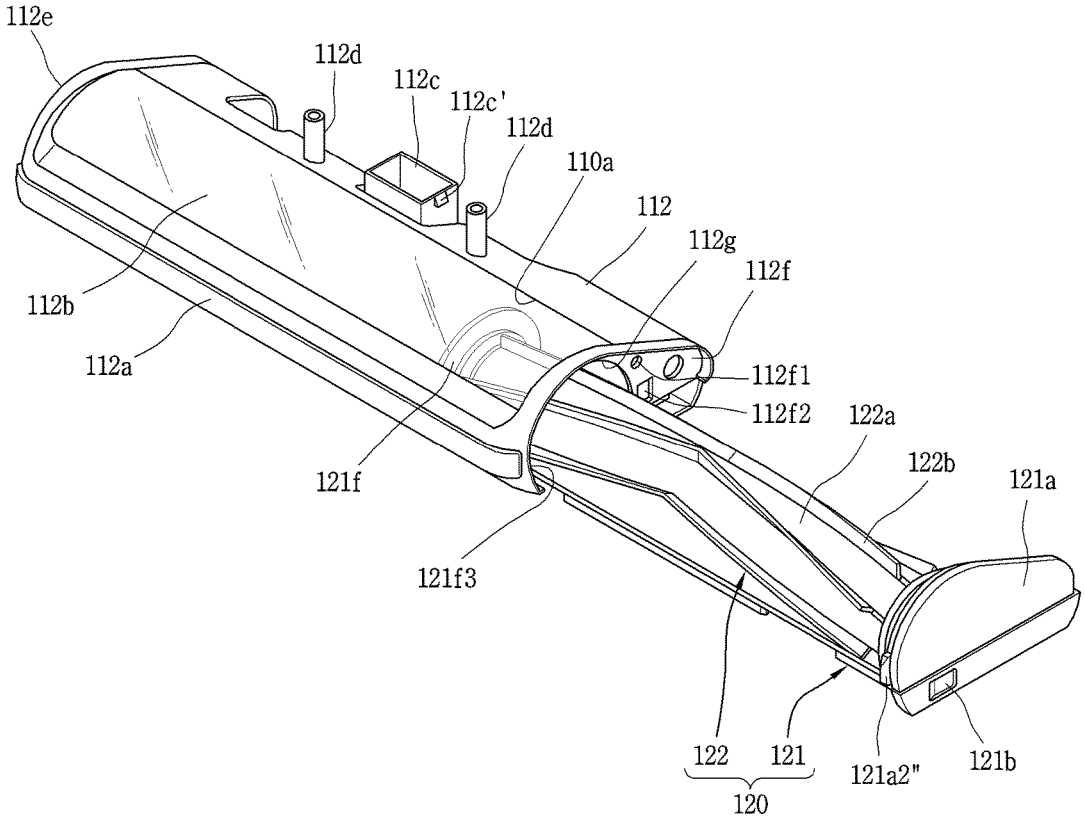
FIG. 5 is a perspective view showing an inserted or withdrawn state of the cleaning module into or from the cleaning module housing.

FIG. 5 is a perspective view showing an inserted or withdrawn state of the cleaning module 120 into or from the cleaning module housing 112. The cleaning module 120 is detachably mounted to the module mounting portion 110*a* through one side of the cleaner body 110. Referring to FIG. 5, the cleaning module 120 is inserted into or withdrawn from the module mounting portion 110*a*, through one side of the cleaning module housing 112. The one side of the cleaning module housing 112 means one of right and left ends of the cleaning module housing 112.

The cleaning module housing 112 is provided with the first side surface cover 112*e*, and the holder 121 is provided with the second side surface cover 121*a*. The first side surface cover 112*e* is provided on a position to face one end of the cleaning member 122 mounted to the module mounting portion 110*a*. The second side surface cover 121*a* is provided on a position to face another end of the cleaning member 122 coupled to the holder 121. The first side surface cover 112*e* and the second side surface cover 121*a* may have shapes symmetric with each other.

The cleaning module housing 112 may be formed to enclose an edge of the second side surface cover 121*a*, in a coupled state of the cleaning module 120 to the cleaning module housing 112. And a sealing member (not shown) may be coupled to the edge of the second side surface cover 121*a*. The reason is in order to prevent dust from leaking into a space between the cleaning module housing 112 and the second side surface cover 121*a*.

The cleaning module 120 is detachably mounted to the module mounting portion 110*a*, through one side of the cleaning module housing 112. The hook manipulator 121*b* is provided at the second side surface cover 121*a*, and the cleaning module 120 is separated from the cleaning module housing 112 by a user's input applied to the hook manipulator 121*b*. If the cleaning module 120 is pulled in a detached state of the cleaning module 120 from the cleaning module housing 112, the cleaning module 120 is withdrawn from the module mounting portion 110*a*.

Once the cleaning module 120 is withdrawn from the cleaning module housing 112, the second side surface cover 121*a* is also separated from the cleaning module housing 112, and an inner cover 112*f* provided in the second side surface cover 121*a* is exposed to the outside. A cleaning module inserting hole (also referred to as "a first opening") 112*g* corresponding to the module mounting portion 110*a* is formed at the inner cover 112*f*, and the cleaning module 120 is inserted into or separated from the module mounting portion 110*a* through the cleaning module inserting hole 112*g*. The second side surface cover 121*a* and the inner cover 112*f* are formed to be coupled to each other, which will be explained later with reference to FIG. 6.

The holder 121 is linearly inserted into or withdrawn from the module mounting portion 110*a*, in a side direction of the cleaner body 110. Referring to FIG. 5, the holder 121 is linearly inserted into or withdrawn from the module mounting portion 110*a*, in a side direction (in the right or left direction) of the cleaner body 110.

The cleaning member 122 is supported by the holder 121 so as to be inserted or withdrawn into or from the module mounting portion 110*a*, together with the holder 121 when the holder 121 is inserted thereinto or withdrawn therefrom. The cleaning member 122 is not merely supported by the holder 121, but is supported by the holder 121 so as to be rotatable. An outer circumferential surface of the cleaning member 122 is spaced apart from the holder 121, and the cleaning member 122 can perform a relative rotation with respect to the holder 121 if both ends of the cleaning member 122 are supported by the holder 121.

FIG. 5 shows a configuration that an agitator (blade or brush) 122*b* is coupled to an outer circumferential surface of a rotation rod (roller or roller body) 122*a*, an example of the cleaning member 122. If the outer circumferential surface of the rotation rod 122*a* contacts an inner side surface of the module mounting portion 110*a*, the resulting friction force may prevent a rotation of the agitator 122*b* to clean a floor. Accordingly, it is preferable for the rotation rod 122*a* to be spaced apart from the inner side surface of the module mounting portion 110*a*.

If the agitator 122*b* contacts the inner side surface of the module mounting portion 110*a*, the agitator 122*b* may block dust from being sucked through an entrance of the module mounting portion 110*a*. Accordingly, it is preferable for the agitator 122*b* to be also spaced apart from the inner side surface of the module mounting portion 110*a*.

If both of the rotation rod 122*a* and the agitator 122*b* are spaced apart from the inner side surface of the module mounting portion 110*a*, the inner side surface of the module mounting portion 110*a* is out of a rotation radius of the rotation rod 122*a* and the agitator 122*b*. If the inner side surface of the module mounting portion 110*a* is out of a rotation radius of the cleaning member 122, dust on the agitator 122*b* may be prevented from being transferred to the module mounting portion 110*a*.

If the inner side surface of the module mounting portion 110*a* is out of the rotation radius of the cleaning member 122, the cleaning member 122 does not contact the inner side surface of the module mounting portion 110*a* when the cleaning module 120 is withdrawn. The reason is because the holder 121 is linearly withdrawn in a side direction of the cleaning module housing 112, and the cleaning member 122 is linearly withdrawn along with the holder 121.

If the cleaning member 122 is not supported by the holder 121, the cleaning member 122 may be inclined when withdrawn, and thus may contact the inner side surface of the module mounting portion 110*a*. This may cause dust on the cleaning member 122 to be transferred to the inner side surface of the module mounting portion 110*a*, or to fall on a floor. However, such a problem may be solved in the present disclosure. The reason is because a spaced state of the cleaning member 122 from the inner side surface of the module mounting portion 110*a* is maintained, in a process of withdrawing the cleaning module 120 from the cleaning module housing 112.

Reference numeral 112*f*1 denotes a protrusion inserting hole, and reference numerals 112*f*2 and 112*f*3 denote hook coupling portion inserting holes, which will be explained later.

Figure 6:
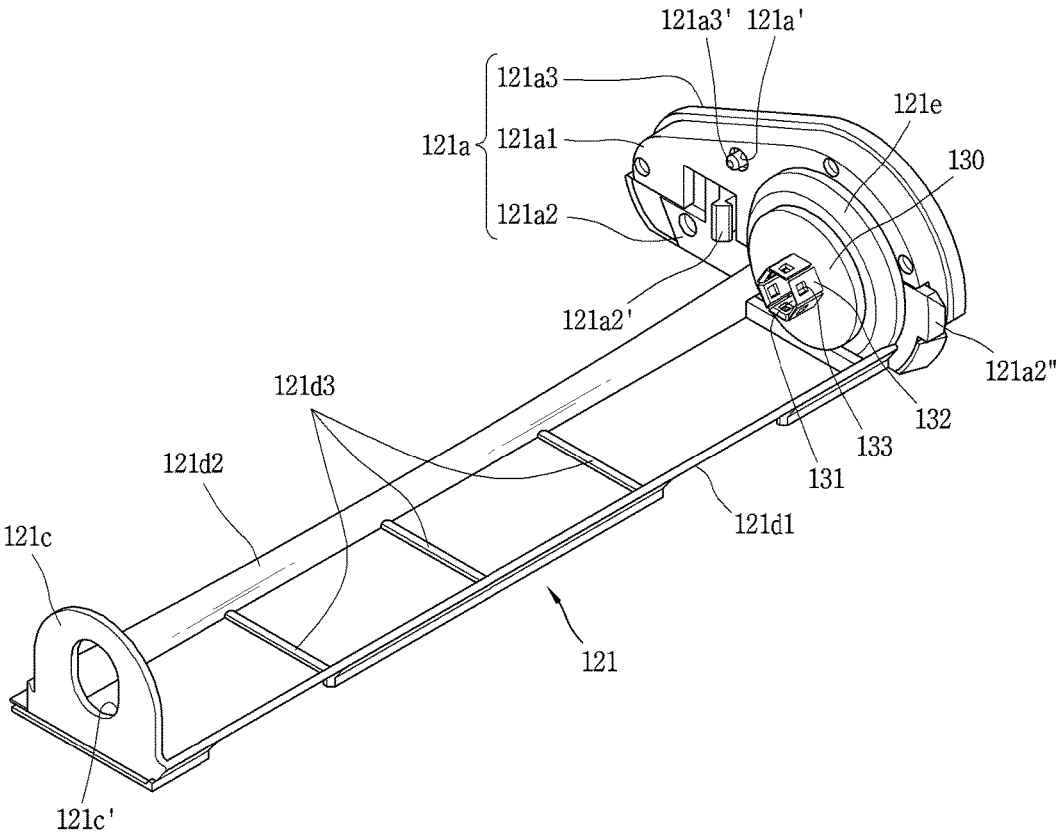
FIG. 6 is a perspective view of a holder.

FIG. 6 is a perspective view of the holder 121. As shown in FIG. 6, the holder 121 may be provided with a rotation driving portion (or drive module) 130 defining a first side surface 121*e* of the holder 121. The rotation driving portion 130 is configured to transmit a driving force to the end of the cleaning member 122 such that the cleaning member 122 is rotated about a rotation shaft (e.g., rotational rod 122*a*) which extends in an inserting direction or withdrawing direction of the cleaning module 120 into or from the module mounting portion 110*a*.

When the rotation driving portion 130 is provided at the holder 121, the rotation driving portion 130 may be inserted into or withdrawn from the module mounting portion 110*a*, together with the holder 121. Accordingly, before the cleaning module 120 is inserted into the module mounting portion 110*a*, the rotation driving portion 130 and the cleaning member 122 may be in a coupled state to each other.

The rotation driving portion 130 is not necessarily provided at the holder 121. For instance, the rotation driving portion 130 may be provided at an inner side of the first side surface cover 112*e* shown in FIG. 5. In this case, even if the holder 121 is withdrawn from the module mounting portion 110*a*, the rotation driving portion 130 is not withdrawn from the module mounting portion 110*a*. And the cleaning member 122 may be coupled to the rotation driving portion 130 after being inserted into the module mounting portion 110*a*.

In any case, in a mounted state in which the cleaning module 120 is coupled to the module mounting portion 110*a*, the rotation driving portion 130 is provided at one side of the module mounting portion 110*a*, and the cleaning member 122 is rotated by a driving force provided from the rotation driving portion 130.

In another example, the rotation driving portion 130 may be provided as two separate components. For instance, one of the two rotation driving portions 130 may be provided at the holder 121, and another thereof may be provided at an inner side of the first side surface cover 112*e*. In this case, the two rotation driving portions 130 are provided at two sides (e.g., left and right sides) of the module mounting portion 110*a*, in a facing manner. The rotation driving portion 130 provided at the holder 121 may be separated from the cleaning module housing 112 along the holder 121, and the position of the rotation driving portion 130 at an inner side of the first side surface cover 112*e* may be fixed.

The holder 121 includes a supporting portion (or supporting extension) 121*c*, and connection portions (or connection surfaces) 121*d*1, 121*d*2, 121*d*3. The supporting portion 121*c* defines a second side surface 121*f* of the holder 121 (see FIG. 5) and is configured to support the cleaning member 122 together with the rotation driving portion 130. Referring to FIG. 6, the supporting portion 121*c* is provided to face the rotation driving portion 130.

Even in a case where the rotation driving portion 130 is provided in two components that are spaced apart, the supporting portion 121*c* may be used. The reason is because the rotation driving portion 130 which is provided at an inner side of the first side surface cover 112*e* is coupled to the cleaning member 122 only when the cleaning module 120 is mounted to the module mounting portion 110*a*. If the supporting portion 121*c* is not provided, the cleaning member 122 may be inserted in an inclined state while the cleaning module 120 is mounted to the module mounting portion 110*a*.

The supporting portion 121*c* is formed to enclose one end of the cleaning member 122, in order to rotatably support the cleaning member 122. For instance, the supporting portion 121*c* is provided with a hole 121*c*', and one end of the cleaning member 122 may be inserted into the hole 121*c*'. In this case, the cleaning member 122 may be rotatable within a region defined by the hole 121*c*' of the supporting portion 121*c*.

The hole 121*c*' of the supporting portion 121*c* may be formed as a slit or oval. If the supporting portion 121*c* is provided with a slit, the cleaning member 122 coupled to the supporting portion 121*c* can move up and down. For instance, in case of cleaning an object having a non-uniform height (e.g., a carpet), it is more preferable for the cleaning member 122 to clean while moving up and down. The slit is not necessarily formed in a vertical direction, but may be formed to be inclined.

The first connection portion 121*d*1 and the second connection portion 121*d*2 are spaced apart from each other, and are configured to connect the rotation driving portion 130 and the supporting portion 121*c* to each other. If the cleaning member 122 is coupled to the holder 121, the first connection portion 121*d*1 is provided at a front side of the cleaning member 122, and the second connection portion 121*d*2 is provided at a rear side of the cleaning member 122. The cleaning member 122 is configured to clean a floor through a space between the first connection portion 121*d*1 and the second connection portion 121*d*2.

The holder 121 may further include a plurality of third connection portions 121*d*3 spaced apart from each other. The plurality of third connection portions 121*d*3 extend in a direction crossing the extended direction of the first and second connection portions 121*d*1, 121*d*2, and are configured to connect the first connection portion 121*d*1 and the second connection portion 121*d*2 to each other. A coupling between the first connection portion 121*d*1 and the second connection portion 121*d*2 may be strengthened by using a plurality of third connection portions 121*d*3. The cleaning member 122 may clean a floor through lattice spaces formed by the first connection portion 121*d*1, the second connection portion 121*d*2, and the third connection portions 121*d*3.

The second side surface cover 121*a* may be formed as a plurality of members. FIG. 6 shows that the second side surface cover 121*a* is formed as three members. A first member 121*a*1 is provided on a position to face the inner cover 112*f* of the cleaning module housing 112 shown in FIG. 5, and a second member 121*a*2 is provided above or below the first member 121*a*1. Referring to FIG. 6, the second member 121*a*2 is provided below the first member 121*a*1. A third member 121*a*3 is provided outside the first and second members 121*a*1, 121*a*2. Since the third member 121*a*3 has a shape corresponding to the first side surface cover 112*e*, the third member 121*a*3 forms an appearance corresponding to the first side surface cover 112*e*. If the first and second members 121*a*1, 121*a*2 are coupled to each other, a shape corresponding to the third member 121*a*3 may be implemented.

A protrusion passing hole 121*a*1' is formed at the first member 121*a*1. And a protrusion inserting groove (or the protrusion inserting hole 112*f*1 shown in FIG. 5) corresponding to the protrusion passing hole 121*a*1' is formed at the inner cover 112*f* of the cleaning module housing 112. The third member 121*a*3 is provided with a protrusion 121*a*3'. Once the first member 121*a*1 and the third member

121*a*3 are coupled to each other, the protrusion 121*a*3' of the third member 121*a*3 protrudes out through the protrusion passing hole 121*a*1' of the first member 121*a*1. Once the cleaning module 120 is coupled to the cleaning module housing 112, the protrusion 121*a*3' of the third member 121*a*3 is inserted into the protrusion inserting groove or the protrusion inserting hole 112*f*1 (refer to FIG. 5). By the protrusion inserting structure, the position of the second side surface cover 121*a* may be fixed.

Figure 7A:
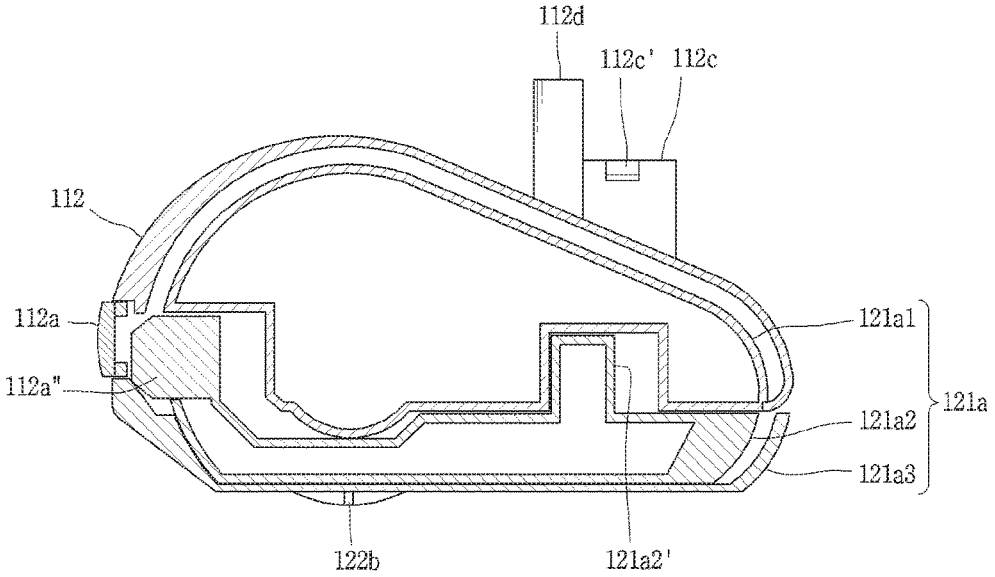
FIGS. 7A and 7B are conceptual views showing a process of separating a cleaning module coupled to a cleaning module housing, from the cleaning module housing.
Figure 7B:
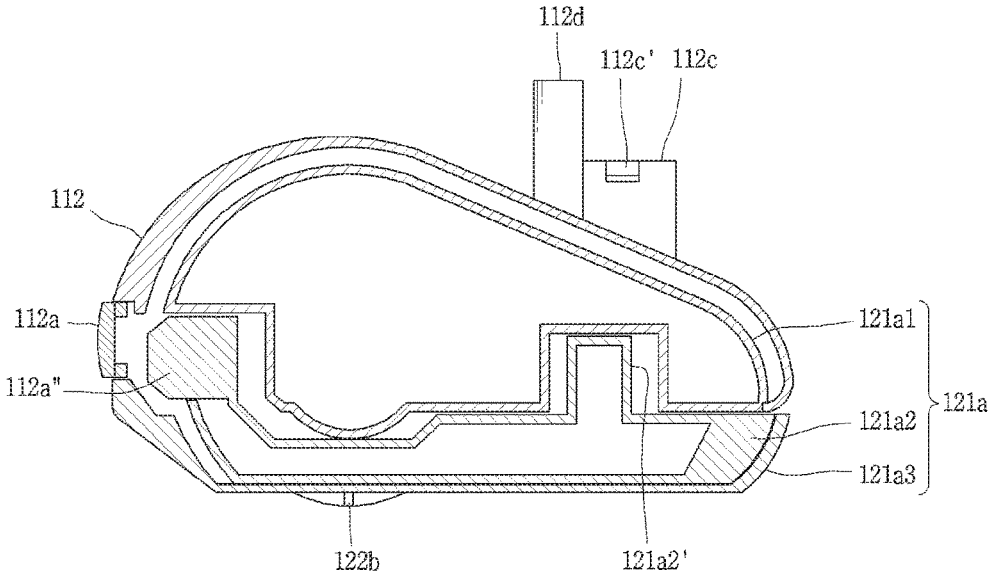

Hereinafter, a structure to couple the cleaning module 120 and the cleaning module housing 112 to each other, and a structure to separate the cleaning module 120 from the cleaning module housing 112 will be explained with reference to FIGS. 5 to 7B. FIGS. 7A and 7B are conceptual views showing a process of separating the cleaning module coupled to the cleaning module housing, from the cleaning module housing (views taken along line 'B-B' in FIG. 5).

The second member 121*a*2 may be provided with hook coupling portions 121*a*2', 121*a*2". The second member 121*a*2 and the hook coupling portions 121*a*2', 121*a*2" may be integrally formed with each other, and the hook coupling portions 121*a*2', 121*a*2" may protrude from the second member 121*a*2 towards the inner cover 112*f*. Hook coupling portion inserting holes 112*f*2, 112*f*3 are formed at the inner cover 112*f* of the cleaning module housing 112, at positions corresponding to the hook coupling portions 121*a*2', 121*a*2".

Once the cleaning module 120 is mounted to the module mounting portion 110*a* through the cleaning module inserting hole 112*g*, the hook coupling portions 121*a*2', 121*a*2" are coupled to the inner cover 112*f* through the hook coupling portion inserting holes 112*f*2, 112*f*3. The first and second members 121*a*1, 121*a*2 are coupled to each other so as to be relatively moveable. In a process of coupling the second side surface cover 121*a* to the cleaning module housing 112, the hook coupling portions 121*a*2', 121*a*2" and the second member 121*a*2 are relatively moved with respect to the first member 121*a*1, and then return to the original position, thereby being coupled to the inner cover 112*f*. For movement and restoration of the second member 121*a*2, an elastic member (not shown) may be coupled the second member 121*a*2.

The coupled state of the hook coupling portions 121*a*2', 121*a*2" may be released by a user's input applied to the hook manipulator 121*b*. The hook manipulator 121*b* is installed on an outer side surface of the third member 121*a*3 in an exposed state, and the hook coupling portions 121*a*2', 121*a*2" are linearly moveable by a user's input applied to the hook manipulator 121*b*. Once the hook coupling portions 121*a*2', 121*a*2" are linearly moveable by using the hook manipulator 121*b*, the hook coupling portions 121*a*2', 121*a*2" and the second member 121*a*2 are relatively moved with respect to the first member 121*a*1, and a coupled state of the hook coupling portions 121*a*2', 121*a*2" and the second member 121*a*2 to the inner cover 112*f* is released. In this state, if the holder 121 is pulled, the hook coupling portions 121*a*2', 121*a*2" are withdrawn out through the hook coupling portion inserting holes 112*f*2, 112*f*3. A tool is not required in manipulating the hook manipulator 121*b*.

Figure 8:
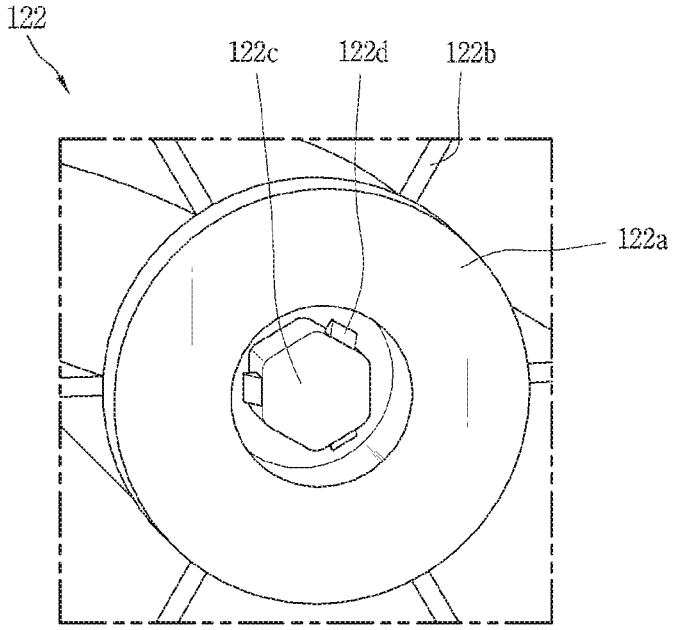
FIG. 8 is a conceptual view of a cleaning member.

FIG. 8 is a conceptual view of the cleaning member 122. The cleaning member 122 is formed such that its two ends are supported by the holder 121 and/or the rotation driving portion 130. FIG. 8 shows the rotation rod 122*a* and the agitator 122*b* as an example of the cleaning member 122. A protruding portion 122*c* which can be inserted into an accommodation groove 131 of the rotation driving portion 130 is provided at one end of the rotation rod 122*a*. The protruding portion 122*c* is formed so as to be engaged with the accommodation groove 131. The engaged state means a state to receive a rotational force as the protruding portion 122*c* and the accommodation groove 131 have shapes corresponding to each other. For instance, if the protruding portion 122*c* has a hexagonal sectional surface as shown in FIG. 7, the accommodation groove 131 has a shape corresponding to the hexagonal sectional surface.

The accommodation groove 131 may be formed as a plurality of plates 132 protrude from the rotation driving portion 130. Referring to FIG. 6, six plates 132 protrude from the rotation driving portion 130. Accordingly, the accommodation groove 131 may accommodate therein the protruding portion 122*c* having a hexagonal sectional surface.

A protrusion 122*d* may be formed at the protruding portion 122*c*, and a hole 133 corresponding to the protrusion 122*d* may be formed at each of the plates 132. As the protruding portion 122*c* is inserted into the accommodation groove 131, the protrusion 122*d* is coupled to the hole 133. This may prevent any separation of the cleaning member 122.

A bearing (not shown) may be coupled to an opposite side to the protruding portion 122*c*. If the bearing is supported by the supporting portion 121*c* of the holder 121, a more smooth rotation of the bearing may be implemented through a reduced frictional force.

The aforementioned cleaner is not limited to the aforementioned embodiments. The embodiments may be selectively combined to each other entirely or partially for various modifications.

In case of mounting or separating the cleaning module to or from the cleaner body (or the cleaning module housing), the cleaning member is inserted or withdrawn in a coupled state to the holder. Since the holder is linearly inserted into or withdrawn from the cleaner body, the cleaning member may be also linearly inserted into or withdrawn from the cleaner body along the holder. This may prevent transfer of dust due to an inclined state of the cleaning member when inserted or withdrawn into or from the cleaner body. Further, since the cleaning member is also inserted or withdrawn into or from the cleaner body by inserting or withdrawing the holder, a user needs not hold the cleaning member when mounting or separating the cleaning module to or from the cleaner body. Thus, this configuration provides improved sanitary aspects.

Further, a coupled state between the cleaning module housing and the cleaning module is released as a user linearly moves the hook manipulator using his or her hand. Thus, a tool is not required to withdraw the cleaning module. Therefore, the detailed description provides a cleaner manufactured with consideration of a user's sanitation in a process of managing the cleaner, etc. Especially, an aspect of the detailed description is to provide a cleaner which allows a user to disassemble or decompose components of the cleaner from a cleaner body, without contacting dust with hands.

The detailed description further provide a cleaner capable of preventing dust on a cleaning module from being transferred to a cleaning module housing or from falling on a floor, in a process of withdrawing the cleaning module. The detailed description also provides a cleaner not requiring any tool to withdraw a cleaning module.

As embodied and broadly described herein, a cleaner, including: a cleaner body having therein a module mounting portion; a rotation driving portion provided at one side of the module mounting portion; and a cleaning module detachably mounted to the module mounting portion through one side of the cleaner body, wherein the cleaning module includes: a holder linearly inserted into or withdrawn from the module mounting portion in a side direction of the cleaner body; and a cleaning member supported by the holder so as to be inserted or withdrawn into or from the module mounting portion, together with the holder when the holder is inserted thereinto or withdrawn therefrom.

The cleaner may include a rotation driving portion provided at one side of the module mounting portion, and the cleaning member may be rotated by a driving force provided from the rotation driving portion.

The rotation driving portion may be configured to transmit a driving force to an end of the cleaning member such that the cleaning member may be rotated about a rotation shaft which extends in an inserting direction or withdrawing direction of the cleaning module. The rotation driving portion may be provided with an accommodation groove exposed towards the rotation shaft of the cleaning module. The cleaning module may be provided with a protruding portion formed to be insertable into the accommodation groove. And the protruding portion may be formed to receive a rotational force by being engaged with the accommodation groove. One or more holes may be formed around the accommodation groove, and a protrusion portion coupled to the hole may be formed around the protruding portion.

The cleaner body may include: a main housing coupled to a dust container; and a cleaning module housing coupled to the main housing in a protruded manner, and having therein the module mounting portion. And the cleaning module may be inserted into or withdrawn from the module mounting portion through one side of the cleaning module housing. The cleaning module housing may be provided with a first side surface cover provided at a position to face one end of the cleaning member. And the holder may be provided with a second side surface cover provided at a position to face another end of the cleaning member, the second side surface cover symmetric with the first side surface cover.

The cleaning module housing may be formed to enclose an edge of the second side surface cover. A sealing member may be coupled to an edge of the second side surface cover. The holder may be provided with a hook manipulator provided at the second side surface cover, and the cleaning module may be separated from the cleaning module housing by a user's input applied to the hook manipulator.

The holder may further include hook coupling portions installed at the second side surface cover and linearly moveable by a user's input applied to the hook manipulator. The cleaning module housing may be provided with an inner cover at a position to face the second side surface cover. The inner cover may include: a cleaning module inserting hole corresponding to the module mounting portion; and hook coupling portion inserting holes corresponding to the hook coupling portions. The hook coupling portions may protrude from the second side surface cover towards the inner cover. And if the cleaning module is mounted to the module mounting portion through the cleaning module inserting hole, the hook coupling portions may be coupled to the inner cover through the hook coupling portion inserting holes.

The inner cover may be provided with a protrusion inserting hole. And the second side surface cover may include: a first member provided at a position to face the inner cover, and having a protrusion passing hole corresponding to the protrusion inserting hole; a second member provided above or below the first member, integrally formed with the hook coupling portions, and linearly moved by a user's input applied to the hook manipulator; and a third member provided outside the first and second members, exposed to outside together with the hook manipulator, forming appearance of the cleaner corresponding to the first side surface cover, and having a protrusion inserted into the protrusion inserting hole via the protrusion passing hole.

The holder may include: a supporting portion provided to face the rotation driving portion, and formed to enclose one end of the cleaning member in order to rotatably support the cleaning member; and a first connection portion and a second connection portion spaced apart from each other, and configured to connect the rotation driving portion and the supporting portion to each other. And the cleaning member may be configured to clean a floor in an exposed state to a space between the first and second connection portions.

The holder may further include a plurality of third connection portions spaced apart from each other. And the plurality of third connection portions may extend in a direction crossing the extended direction of the first and second connection portions, and may be configured to connect the first and second connection portions to each other.

The supporting portion may be provided with a slit for an up and down movement of the cleaning member. An inner side surface of the module mounting portion may be formed to enclose the cleaning member, and may be provided out of a rotation radius of the cleaning member. A spaced state of the cleaning member from an inner side surface of the module mounting portion may be maintained, in a process of withdrawing the cleaning module from the cleaner body.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner, comprising:

a cleaner body having a module mounting portion defining an interior space, the module mounting portion having a first opening in a first side and a second opening on a bottom; and a cleaning module detachably mounted in the interior space, the cleaning module including:

a cleaning member including a roller body and at least one cleaning element attached to the roller body, a holder having a first side surface, a second side surface, and one or more connection members that extend between the first side surface and the second side surface, wherein:

the first side surface of the holder covers the first opening when the cleaning module is mounted in the interior space, axial ends of the roller body are rotatably supported between the first side surface and the second side surface of the holder to position the cleaning element in the second opening to clean a surface under the cleaner body, and the cleaning member and the holder are concurrently inserted into or withdrawn from the interior space through the first opening.

2. The cleaner of claim 1, further comprising a driving module provided within the interior space, wherein the driving module transmits a driving force to an end of the cleaning member to rotate the cleaning member around a rotational axis that corresponds to an inserting direction or withdrawing direction of the cleaning module.

3. The cleaner of claim 2, wherein the driving module is coupled to one of the first side surface or the second side surface of the holder, and wherein the cleaning member is mounted between the driving module and a supporting surface at another one of the first side surface or the second side surface of the holder facing the driving module.

4. The cleaner of claim 3, wherein the supporting surface includes a slit to receive one of the axial ends of the roller body, and wherein the slit is oriented to allow the axial end of the roller body to move within the slit toward or away from the second opening.

5. The cleaner of claim 2, wherein:

the driving module includes an accommodation groove, the cleaning module includes a protrusion at one of the axial ends that is shaped to be inserted into the accommodation groove when the cleaning module is supported by the holder, driving module applies the driving force to rotate the accommodation groove, and the rotating of the accommodation groove transfers the driving force to the protrusion to rotate the cleaning module.

6. The cleaner of claim 5, wherein one or more holes are formed in the accommodation groove, and wherein the protrusion of the cleaning body include one or more extensions that pass into the one or more holes of the accommodation groove to couple the cleaning module to the driving module.

7. The cleaner of claim 2, wherein the driving module includes a first component providing the driving force to one end of the cleaning module, and a second component providing the driving force to another end of the cleaning module.

8. The cleaner of claim 1, wherein the cleaner body further includes:

a main housing, the main housing defining a space to accommodate one or more of a suction motor to apply a suction force to the second opening or a dust container to store contaminants collected by the cleaning module; and a cleaning module housing coupled to the main housing, the cleaning module housing defining the module mounting portion.

9. The cleaner of claim 8, wherein the cleaning module housing defines a second side surface cover positioned near the second side surface of the holder, and wherein the first side surface of the holder defines a first side surface cover, the first and the second side surface covers being symmetric.

10. The cleaner of claim 9, wherein the cleaning module housing is formed to enclose an edge of the second side surface cover.

11. The cleaner of claim 9, wherein a sealing member is coupled to an edge of the second side surface cover.

12. The cleaner of claim 9, wherein the holder includes a release button provided at the second side surface cover, and the cleaning module is separated from the cleaning module housing when user input is applied to the release button.

13. The cleaner of claim 12, wherein the holder further includes hook coupling portions in the second side surface cover and that are linearly moveable by the user input applied to the release button.

14. The cleaner of claim 13, wherein the cleaning module housing includes an inner cover at a position to face the second side surface cover, and wherein the inner cover includes:

a cleaning module inserting hole corresponding to the module mounting portion; and hook coupling portion inserting holes corresponding to the hook coupling portions, wherein the hook coupling portions protrude from the second side surface cover towards the inner cover, and wherein if the cleaning module is mounted to the module mounting portion through the cleaning module inserting hole, the hook coupling portions are coupled to the inner cover through the hook coupling portion inserting holes.

15. The cleaner of claim 14, wherein the inner cover includes a protrusion inserting hole, and wherein the second side surface cover includes:

a first member provided at a position to face the inner cover, and having a protrusion passing hole corresponding to the protrusion inserting hole;

a second member provided above or below the first member, integrally formed with the hook coupling portions, and linearly moved by a user's input applied to the hook manipulator; and a third member provided outside the first and second members, exposed to outside together with the hook manipulator, forming an appearance corresponding to the first side surface cover, and having a protrusion inserted into the protrusion inserting hole via the protrusion passing hole.

16. The cleaner of claim 1, wherein the one or more connection members of the holder include a first connection portion and a second connection portion spaced apart from each other, and positioned between the first side surface and the second side surface of the holder.

17. The cleaner of claim 16, wherein the holder further includes a plurality of third connection portions spaced apart from each other, and wherein the plurality of third connection portions extend in a direction crossing an extending direction of the first and second connection portions, and are configured to connect the first and second connection portions.

18. The cleaner of claim 1, wherein an inner side surface of the module mounting portion is formed to enclose the cleaning member, and is provided out of a rotation radius of the cleaning member.

19. The cleaner of claim 1, wherein the holder prevents the cleaning member from being inclined when the cleaning module is removed from the interior space through the first opening.

20. The cleaner of claim 1, further comprising a connection passage coupled to the module mounting portion to receive a suction force.

* * * * *